United States Patent [19]

Bastien

[11] Patent Number: 5,000,493

[45] Date of Patent: Mar. 19, 1991

[54] SELF-PRESENTING SECONDARY HOOD LATCH HANDLE

[75] Inventor: Joseph L. Bastien, Yale, Mich.

[73] Assignee: General Motors Corporation, Detroit, Mich.

[21] Appl. No.: 550,277

[22] Filed: Jul. 9, 1990

[51] Int. Cl.[5] ..... E05B 3/00

[52] U.S. Cl. ..... 292/11; 292/DIG. 14; 292/336.3; 292/49

[58] Field of Search ..... 292/24, 28, 11, 336.3, 292/DIG. 14, 225, 235, 171, 125, 141, 49, DIG. 65; 74/497

[56] References Cited

U.S. PATENT DOCUMENTS

| | | | |
|---|---|---|---|
| 2,841,430 | 7/1958 | Krause | 292/DIG. 14 X |
| 3,966,244 | 6/1976 | Kleisser et al. | 292/127 |
| 3,972,549 | 8/1976 | Valade | 292/DIG. 14 X |
| 4,706,478 | 11/1987 | Swan et al. | 292/336.3 X |
| 4,756,562 | 7/1988 | Foster et al. | 292/28 |

*Primary Examiner*—Richard E. Moore

*Attorney, Agent, or Firm*—Raymond I. Bruttomesso, Jr.

[57] ABSTRACT

A secondary hood latch is rotatably mounted on a body panel of a vehicle body and engageable by a striker mounted on a hood panel upon partial opening movement from a fully closed position to retain the hood against full opening movement subsequent to release of a primary latch. A cam member is rotatably mounted on the latch and has an interengagement with the striker so that the cam member is rotated in one direction during closing movement of the hood to the fully closed position and rotated in the other direction during opening movement of the hood from the fully closed position. A handle is carried by the cam member so that the handle is rotated therewith and estabilished in a retracted position concealed within the vehicle body when the cam member is rotated in one direction during closing movement of the hood and established in an extended occupant accessible position projecting out of the vehicle body when the cam member is rotated in the other direction during opening movement of the hood. Engagement of the handle with the secondary hood latch when the handle is established in the extended position forms a driving connection, so that occupant actuation of the handle disengages the secondary hood latch from engagement with the striker to permit full opening movement of the hood.

3 Claims, 2 Drawing Sheets

SELF-PRESENTING SECONDARY HOOD LATCH HANDLE

This invention relates to a hood latch and, more particularly, to a hood latch having a secondary latch release handle that is presented upon the releasing of a primary hood latch.

BACKGROUND OF THE INVENTION

It is known to have a hood latch assembly including a primary latch which may be released from the interior of the vehicle as desired and a secondary or safety latch which holds the hood in a partially open position after the primary latch is released.

It is also known to provide a handle under the hood for operating the secondary latch to allow full opening of the hood. The hood is biased upwardly when the primary latch is released, thereby leaving a small gap or opening into which a person may extend their hand to grasp the handle and operate the secondary latch. The location of this handle for the secondary latch is not the same from model to model due to differences in design and may be difficult to reach. It is known to provide a release lever on the secondary latch such as disclosed in U.S. Pat. No. 3,966,244, where the release lever is presented upon unlatching of the primary latch. Such a release lever is pivotally mounted to the secondary latch such that when the hood is partially raised, the lever is projected straight out through the radiator grill toward the operator, however, the release lever is biased to a retracted position both when the hood is open and closed. Therefore, the release lever will move straight out towards an operator as the operator is closing the hood.

It would be desirable to provide a secondary hood latch handle which is integral with a cam surface which, when the closure panel is raised from the closed position to a secondary latch position, the cam surface presents a latch handle.

SUMMARY OF THE INVENTION

This invention provides a secondary hood latch rotatably mounted on a body panel of a vehicle body and engageable by a striker mounted on a hood panel upon partial opening movement from a fully closed position to retain the hood against fully opening movement subsequent to release of a primary latch. The secondary hood latch acts as a latch lever and has an arm that is engageably engaged to rotate the secondary latch to allow further opening movement of the vehicle closure panel. A latch spring is mounted between the latch lever and the body panel for biasing the latch lever into engagement with the striker. A pop-up spring mounts to the hood panel for urging the vehicle hood panel from the closed position toward the opened position. A cam member is rotatably mounted to the body panel and has an interengagement with the striker, so that the cam member is rotated in one direction during closing movement of the hood to the fully closed position and rotated in the other direction during opening movement of the hood from the fully closed position. A handle is carried by the cam member so that the handle is rotated therewith and established in a retracted position concealed within the vehicle body when the cam member is rotated in one direction during closing movement of the hood and established in an extended occupant accessible position projecting out of the vehicle body when the cam member is rotated in the other direction during opening movement of the hood. A cam spring urges rotation of the cam member in the direction establishing the handle in the extended position. The handle has a projection for engaging the arm of the latch lever establishing a driving connection between the handle and the latch lever when the handle is established in the extended position so that occupant actuation of the handle disengages the latch lever from engagement with the striker to permit full opening movement of the hood.

One object, feature and advantage of the invention resides in a cam member rotatably mounted on the body panel and having an interengagement with a striker for rotary motion during movement of the hood and a handle carried by the cam member so that the handle rotates with the cam member.

Another object, feature and advantage of the invention resides in the handle having a projection for engaging a latch lever establishing a driving connection between the handle and the latch lever when the handle is established in an extended position so that occupant actuation of the handle disengages the latch lever from engagement with the striker to permit full opening movement of the hood.

Further objects, features and advantages of the present invention will become more apparent to those skilled in the art as the nature of the invention is better understood from the accompanying drawings and detailed description.

DESCRIPTION OF THE PREFERRED EMBODIMENT

Figure 1:
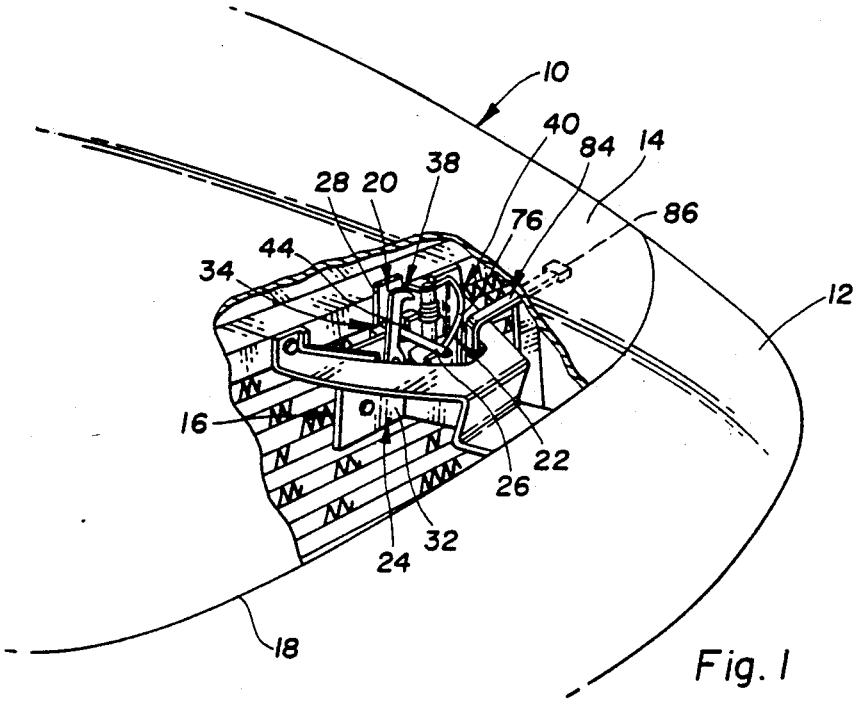
FIG. 1 is a fragmentary perspective view of the forward portion of the vehicle with the hood in the closed position.

A motor vehicle 10 has a closure panel or hood 14 pivotally mounted thereon for movement between an opened position and a closed position. A latch mechanism 16 disengageably connects a non-hinged end 18 of the closure panel 14 to a vehicle panel 12 as seen in FIG. 1.

Figure 2:
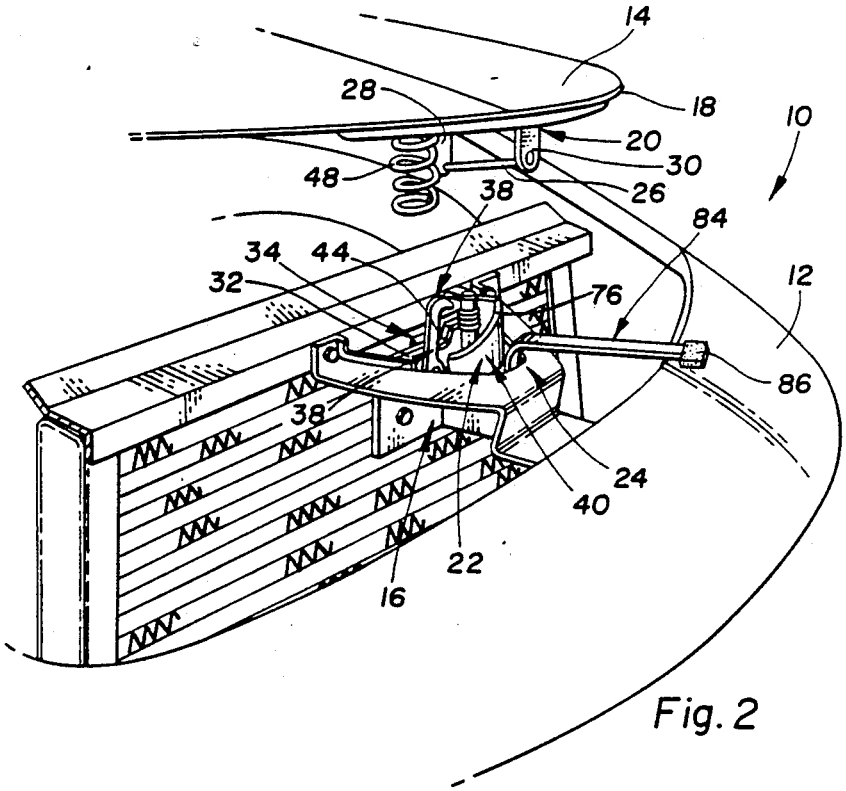
FIG. 2 is a perspective view of the forward portion of the vehicle with the hood in the opened position and the handle in the extended position.

The latch mechanism 16 has a striker portion 20 and a latch portion 22 as best seen in FIG. 2. The striker portion 20 has a striker post 26 spaced laterally from the closure panel 14 by a pair of supports 28 and 30.

Figure 3:
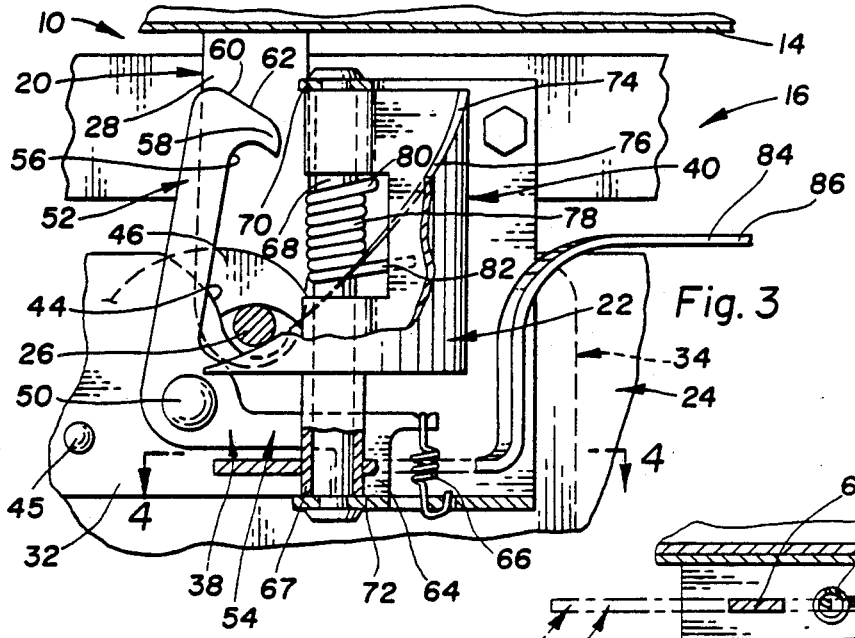
FIG. 3 is a sectional view of the latch mechanism in the primary latched position.

The latch portion 22 has a housing 24 which is mounted to the vehicle panel 12 as seen in FIG. 2. FIG. 3 shows a primary latch 34, a secondary latch 38 and a cam member 40 which are mounted on a support plate 32 of the housing 24. A notch 44 is cut in the support plate 32 to receive the striker post 26 when the closure panel 14 is lowered to the closed position.

Referring to FIG. 3, the primary latch 34 includes a bolt 46 rotatably mounted on the support plate 32 by a pivot 45. The bolt 46 engages with the striker post 26 as shown in FIG. 3 to retain the closure panel 14 in the closed position. The bolt 46 of the primary latch 34 is connected by a cable to a handle located in the vehicle 10 so that the operator may rotate the bolt 46 to release the striker 26. A pop-up spring 48, as seen in FIG. 2, biases the closure panel 14 towards the open position.

Figure 5:
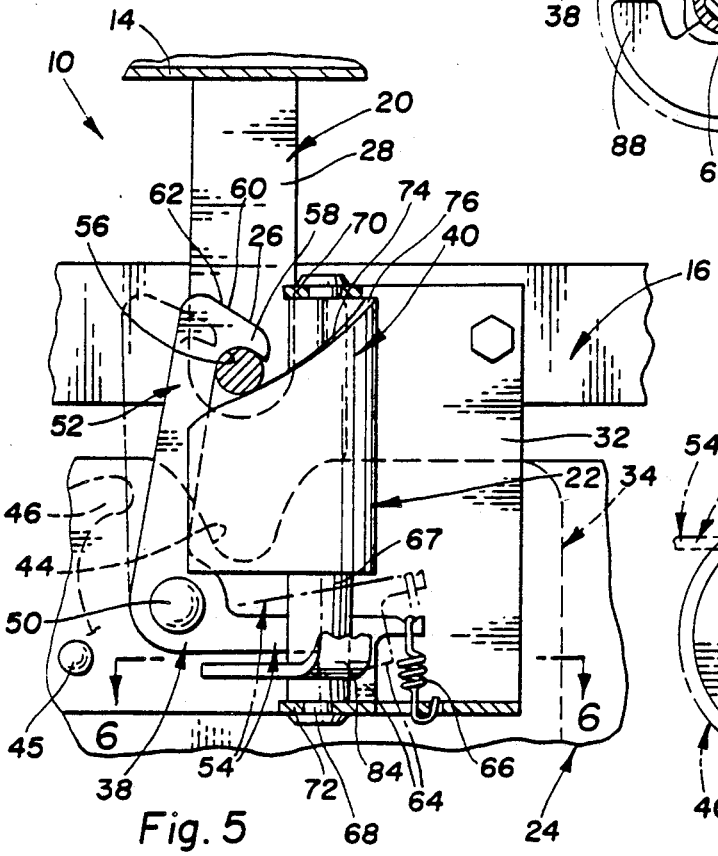
FIG. 5 is a sectional view of the latch mechanism in the secondary latched position. The secondary latch is shown in phantom in the released position.

FIG. 3 shows the secondary latch 38 which acts as latch lever and is pivotally mounted on the support plate 32 by a rivet 50. The latch lever 38 has a first leg 52 projecting generally upwardly and a second leg 54 projecting generally rightwardly from the rivet 50. A cut out 56 forms a hook portion 58 near an upper edge 60 of the first leg 52 to retain the striker post 20 in a secondary latch position as shown in FIG. 5. A curved surface 62 is formed on the upper edge 60 of the latch lever 38, so that as the closure panel 14 is closed, the striker post 26 makes contact with the curved surface 62 and forces the latch lever 38 to rotate counterclockwise as discussed below. An arm 64 projects downward from the second leg 54 of the latch lever 38. When the arm 64 moves rightwardly to the phantom position of FIG. 5, the arm 64 also rotates upwards rotating the first leg 52 of the latch lever 38 counterclockwise away from the striker post 26 to a release position shown in phantom in FIG. 5.

As seen in FIG. 3, a secondary latch spring 66 is connected between the second leg 54 of the latch lever 38 and the housing 24 for biasing the latch lever 38 clockwise, to the position enabling the hook portion 58 to engage the striker post 26.

Referring to FIG. 3, the cam member 40 is mounted to a bushing 67, which surrounds and is rotatably mounted to a shaft 68. The shaft 68 is attached to a pair of brackets 70 and 72 that project from the support plate 32. The cam member 40 has a top edge 74 that slopes downward in a clockwise direction around the cam member 40 to form a cam surface 76. The cam surface 76 engages the striker post 26 as the closure panel 14 is opened and closed.

Figure 4:
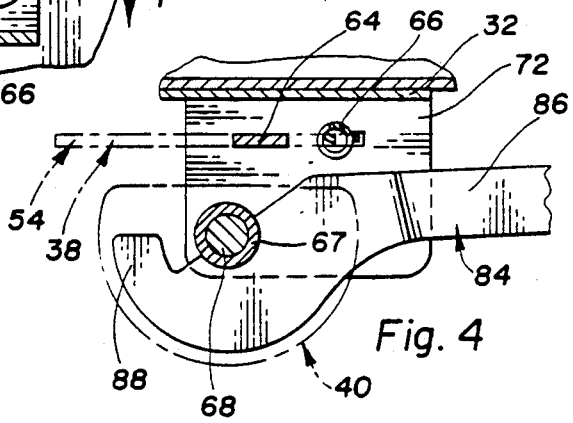
FIG. 4 is a sectional view taken in the direction of arrows 4—4 of FIG. 3 and shows the handle in the retracted position.

As seen in FIG. 3, a secondary latch handle 84 is welded or otherwise suitably attached to the bushing 67 and rotates with the cam member 40. The secondary latch handle 84 has a handle portion 86 that projects out from the vehicle panel 12 in an extended position as best seen in FIG. 2 when the cam member 40 is rotated to the position shown in FIG. 5. The handle portion 86 is in a retracted position as best seen in FIG. 1 when the cam member is rotated to the position shown in FIG. 3. FIG. 4 shows a projection 88 which is formed on the secondary latch handle 84 at the opposite end from the handle portion 86. The projection 88 engages the arm 64 of the latch lever 38 when the handle portion 86 is in the extended position of FIG. 6. Accordingly, rotation of the handle portion 86 rotates the projection 88 of the secondary latch handle 84, which in turn rotates the latch lever 38 in a counterclockwise direction to a release position shown in phantom in FIGS. 5 and 6. This rotation thereby disengages the hook portion 58 from the striker post 26.

A cam spring 78 encircles the shaft 68 and has a first end 80 anchored on the support plate 32 and a second end 82 anchored on the cam member 40. The cam spring 78 biases the cam member 40 and the secondary latch handle 84 in the clockwise direction moving the handle portion 86 toward the extended position of FIGS. 2, 5 and 6.

Referring to FIG. 1, to open the closure panel 14, the handle inside the vehicle is pulled which pulls the cable. The cable rotates the bolt 46 about the pivot 45 in the counterclockwise direction releasing the striker post 26 from the primary latch 34. The pop-up spring 48, shown in FIG. 2, forces the closure panel 14 toward the open position moving the striker post 26 upward with the closure panel 14. The striker post 26 engages the hook portion 58 of the latch lever 38 to limit the upward movement of the striker post 26 and the closure panel 14. At the same time, the cam spring 78 urges the cam member 40 and the secondary latch handle 84 in a clockwise direction rotating the handle portion 86 from the retracted position shown in FIG. 1 to the extended position shown in FIG. 2. The striker post 26 rides against the cam surface 76 limiting this clockwise movement of the cam member 40 and the secondary latch handle 84.

Figure 6:
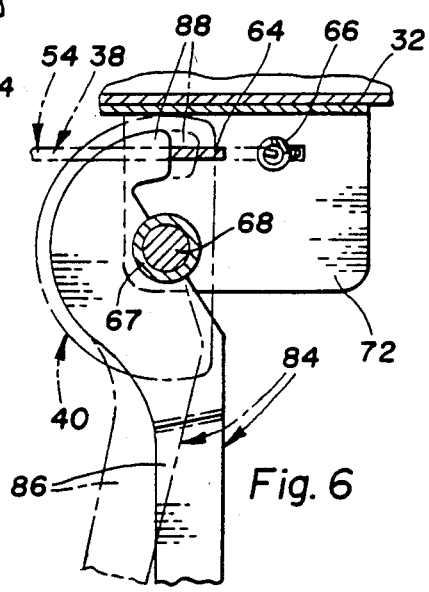
FIG. 6 is a sectional view taken in the direction of arrows 6—6 of FIG. 5 and shows the handle in the extended position. The handle is shown in the released position in phantom.

With the handle portion 86 in the extended position shown in FIGS. 2, 5, and 6, the operator can move the handle portion 86 to the release position shown in phantom in FIGS. 5 and 6. This movement causes the projection 88 of the secondary latch handle 84, which is engaged with the arm 64 on the second leg 54 of the latch lever 38 to rotate the latch lever 38 counterclockwise. As the hook portion 58 of the secondary latch 26 rotates out of the path of the striker post 26 allowing the pop-up spring 48 to continue to force the closure panel 14 towards the open position, the cam member 40 with the cam surface 76 moves with the secondary latch handle 84 also forcing the striker post 26 and closure panel 14 towards the opened position. The striker post 26 and the closure panel 14 may then be lifted to a fully opened position.

When the operator releases the handle portion 86, the secondary latch spring 66 returns the latch lever 38 back to the position shown in FIG. 5. Coincidentally, the arm 64 of the latch lever 38, which is engaged with the projection 88 of the secondary latch handle 84, rotates clockwise returning the secondary latch handle 84 to the extended position of FIG. 6. This is possible since the force imparted by the secondary latch spring 66 on the engaged arm 64 of the latch lever 38 and the projection 88 of the secondary latch handle 84 is greater than the force imparted by the cam spring 78, therefore the latch lever 38 rotates clockwise and the secondary latch handle 84 rotates counterclockwise. Further movement of the latch lever 38 in this direction is prevented since the arm 64 hits the bracket 72.

When the closure panel 14 is lowered, the striker post 26 comes in contact with the curved surface 62 of the latch lever 38 and pushes against the curved surface 62 forcing the latch lever 38 counterclockwise. When the striker post 26 passes below the curved surface 62, the secondary latch spring 66 forces the latch lever 38 back into its original position shown in FIG. 5, with the striker post 26 engaged by the hook portion 58 of the latch lever 38. The secondary latch handle 84 would have to be rotated to the release position again if the closure panel 14 were to be moved to the fully opened position.

As the closure panel 14 is continued to be forced lower, the striker post 26 makes contact with the cam surface 76 and rotates the cam surface 40 in a counterclockwise direction against the bias of the cam spring 78. The bushing 67 and the secondary latch handle 84 move with the cam surface 40 causing the handle portion 86 to move to the retracted position of FIGS. 1, 3 and 4. When the striker post 26 has rotated the cam surface 40 to a point where the primary latch 34 receives the striker post 26, the bolt 46 of the primary latch 34 rotates about the pivot 45 to retain the striker post 26 in the notch 44.

While an embodiment of the present invention has been explained, various modifications within the spirit and scope of the following claims will be readily apparent to those skilled in the art.

The embodiments of the invention in which an exclusive property or privilege is claimed are defined as follows:

1. In a vehicle body having a hood panel hinged for movement between opened and closed positions, a primary hood latch latching the hood in a fully closed position, and a secondary hood latch mounted on one panel and engageable by a striker mounted on the other panel upon part opening movement from the fully closed position to retain the hood against full opening movement subsequent to release of the primary latch, the secondary hood latch comprising:

a latch lever engageable with the striker upon partial opening movement of the hood subsequent to release of the primary hood latch to block further opening movement of the hood;

a cam member rotatably mounted on the latch and having an interengagement with the striker so that the cam member is rotated in one direction during closing movement of the hood to the fully closed position and rotated in the other direction during opening movement of the hood from the fully closed position;

a handle carried by the cam member so that the handle is rotated therewith and established in a retracted position concealed within the vehicle body when the cam member is rotated in one direction during closing movement of the hood and established in an extended occupant accessible position projecting out of the vehicle body when the cam member is rotated in the other direction during opening movement of the hood; and means establishing a driving connection between the handle and the latch lever when the handle is established in the extended position so that occupant actuation of the handle disengages the latch lever from engagement with the striker to permit full opening movement of the hood.

2. In a vehicle body having a hood panel hinged for movement between opened and closed positions, a primary hood latch latching the hood in a fully closed position, and a secondary hood latch mounted on one panel and engageable by a striker mounted on the other panel upon part opening movement from the fully closed position to retain the hood against full opening movement subsequent to release of the primary latch, the secondary hood latch comprising:

a latch lever rotatably mounted on one panel engageable with the striker upon partial opening movement of the hood subsequent to release of the primary hood latch to block further opening movement of the hood, and the latch lever having an arm that engageably engages to rotate the secondary latch to allow further opening movement of the vehicle closure panel;

a latch spring mounted between the latch lever and the one panel for biasing the latch lever into engagement with the striker;

a pop-up spring means mounted to either panel for urging the vehicle hood panel from the closed position toward the opened position;

a cam member rotatably mounted on the one panel and having an interengagement with the striker so that the cam member is rotated in one direction during closing movement of the hood to the fully closed position and rotated in the other direction during opening movement of the hood from the fully closed position;

a handle carried by the cam member so that the handle is rotated therewith and established in a retracted position concealed within the vehicle body when the cam member is rotated in one direction during closing movement of the hood and established in an extended occupant accessible position projecting out of the vehicle body when the cam member is rotated in the other direction during opening movement of the hood;

a rotation means to bias the handle to the extended position; and means establishing a driving connection between the handle and the arm of the latch lever when the handle is established in the extended position so that occupant actuation of the handle disengages the latch lever from engagement with the striker to permit full opening movement of the hood.

3. In a vehicle body having a hood panel hinged for movement between opened and closed positions, a primary hood latch latching the hood in a fully closed position, and a secondary hood latch mounted on the body panel and engageable by a striker mounted on the hood panel upon part opening movement from the fully closed position to retain the hood against full opening movement subsequent to release of the primary latch, the secondary hood latch comprising:

a latch lever rotatably mounted on the body panel and engageable with the striker upon partial opening movement of the hood subsequent to release of the primary hood latch to block further opening movement of the hood, and the latch lever having an arm that engageably engages to rotate the secondary latch to allow further opening movement of the vehicle closure panel;

a latch spring mounted between the latch lever and the body panel for biasing the latch lever into engagement with the striker;

a pop-up spring means mounted to the hood panel for urging the vehicle closure panel from the closed position toward the opened position;

a bushing rotatably mounted to the body panel;

a cam member mounted on the bushing and having an interengagement with the striker so that the cam member is rotated in one direction during closing movement of the hood to the fully closed position and rotated in the other direction during opening movement of the hood from the fully closed position;

a handle carried by the bushing so that the handle is rotated therewith and established in a retracted position concealed within the vehicle body when the cam member is rotated the in one direction during closing movement of the hood and established in an extended occupant accessible position projecting out of the vehicle body when the cam member is rotated in the other direction during opening movement of the hood;

a cam spring mounted between the bushing and the body panel for biasing the handle to the extended position; and the handle having a projection for engaging the arm of the latch lever establishing a driving connection between the handle and the latch lever when the handle is established in the extended position so that occupant actuation of the handle disengages the latch lever from engagement with the striker to permit full opening movement of the hood.

* * * * *